US010273628B2

(12) United States Patent
Je et al.

(10) Patent No.: US 10,273,628 B2
(45) Date of Patent: Apr. 30, 2019

(54) CONTROL METHOD FOR LAUNDRY DRYING MACHINE

(71) Applicant: LG ELECTRONICS INC., Seoul (KR)

(72) Inventors: Haeyoon Je, Seoul (KR); Junseok Lee, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 0 days.

(21) Appl. No.: 15/709,937

(22) Filed: Sep. 20, 2017

(65) Prior Publication Data

US 2018/0080169 A1 Mar. 22, 2018

(30) Foreign Application Priority Data

Sep. 21, 2016 (KR) ..... 10-2016-0120912

(51) Int. Cl.

*D06F 58/22* (2006.01)
*D06F 58/02* (2006.01)
*D06F 58/28* (2006.01)
*D06F 58/20* (2006.01)

(52) U.S. Cl.

CPC ..... *D06F 58/22* (2013.01); *D06F 58/02* (2013.01); *D06F 58/206* (2013.01); *D06F 58/28* (2013.01); *D06F 2058/287* (2013.01); *D06F 2058/2829* (2013.01); *D06F 2058/2858* (2013.01); *D06F 2058/2883* (2013.01)

(58) Field of Classification Search

CPC ..... D06F 58/22; D06F 58/02; D06F 58/206; D06F 58/28; D06F 2058/2829; D06F 2058/2058; D06F 2058/287; D06F 2058/2883

USPC ..... 34/427

See application file for complete search history.

(56) References Cited

U.S. PATENT DOCUMENTS 4,100,763 A * 7/1978 Brody ..... F24D 11/0285 62/238.6
4,103,433 A * 8/1978 Taylor ..... D06F 58/20 165/104.26
4,123,851 A * 11/1978 Itoh ..... D06F 58/02 219/504
4,173,924 A * 11/1979 Bradshaw ..... B05B 16/60 454/52
4,314,409 A * 2/1982 Cartier ..... D06F 58/22 34/604

(Continued)

FOREIGN PATENT DOCUMENTS

DE 10103905 A1 * 8/2002 ..... D06F 58/203
EP 2 690 212 1/2014

(Continued)

OTHER PUBLICATIONS

European Search Report dated Feb. 13, 2018 issued in Application No. 17192034.1.

*Primary Examiner* — Stephen M Gravini
(74) *Attorney, Agent, or Firm* — Ked & Associates, LLP

(57) ABSTRACT

Disclosed is a control method for a laundry drying machine. The control method includes driving a compressor configuring the heat pump cycle for generation of heated air, sensing a compressor outlet temperature (TE) and a drum outlet temperature (TD), and determining plugging of a filter, based on a difference between the compressor outlet temperature (TE) and the drum outlet temperature (TD).

20 Claims, 7 Drawing Sheets

(56) References Cited

U.S. PATENT DOCUMENTS 5,058,401 A * 10/1991 Nakamura ..... D06F 25/00 68/19.2
5,343,632 A * 9/1994 Dinh ..... F26B 21/086 34/507
6,094,835 A * 8/2000 Cromer ..... D06F 58/20 34/77
6,158,148 A * 12/2000 Krausch ..... D06F 58/28 34/497
8,789,287 B2 * 7/2014 Kim ..... D06F 58/22 34/480
9,134,068 B2 * 9/2015 Choi ..... D06F 58/28
9,670,613 B2 * 6/2017 Ko ..... D06F 58/203
9,677,218 B2 * 6/2017 Ros ..... D06F 58/28
9,731,865 B2 * 8/2017 He.beta ..... B65D 25/14
9,803,312 B2 * 10/2017 Chung ..... D06F 58/206
9,834,882 B2 * 12/2017 Patil ..... F26B 21/086
9,845,567 B2 * 12/2017 Contarini ..... D06F 58/24
9,896,797 B2 * 2/2018 Shin ..... D06F 58/02
9,982,384 B2 * 5/2018 Shin ..... D06F 58/20
10,006,721 B2 * 6/2018 Kohavi ..... F16L 53/00
10,012,398 B2 * 7/2018 Swanson ..... F24F 1/025
2004/0006886 A1 1/2004 Lee et al.
2005/0066538 A1 * 3/2005 Goldberg ..... D06F 58/206 34/218
2007/0151311 A1 * 7/2007 McAllister ..... D06F 35/001 68/3 R
2017/0037560 A1 * 2/2017 Shin ..... D06F 58/02
2017/0037561 A1 * 2/2017 Shin ..... D06F 58/02
2017/0350064 A1 * 12/2017 Shin ..... D06F 58/22
2018/0038042 A1 * 2/2018 Karagoz ..... D06F 58/206
2018/0080169 A1 * 3/2018 Je ..... D06F 58/22

FOREIGN PATENT DOCUMENTS

JP 6328845 B2 * 5/2018 ..... D06F 58/22
KR 10-2005-0041657 5/2005
KR 101467494 B1 * 12/2014
WO WO 02061197 A1 * 8/2002 ..... D06F 58/203

* cited by examiner

CONTROL METHOD FOR LAUNDRY DRYING MACHINE

CROSS-REFERENCE TO RELATED APPLICATION(S)

This application claims priority under 35 U.S.C. § 119 to Korean Application No. 10-2016-0120912, filed on Sep. 21, 2016, whose entire disclosure is hereby incorporated by reference.

BACKGROUND

1. Field

The present disclosure relates to a control method for a laundry drying machine.

2. Background

A laundry drying machine for drying the laundry is a type of laundry processing apparatus which allows high-temperature heated air to be supplied to an interior of a dry drum while a dry drum into which the laundry is introduced is rotating in one direction or two directions, thereby allowing the wet laundry to be dried.

Generally, one of a gas combustion type, an electric heater type, and a heat pump cycle type may be applied for generating high-temperature heated air supplied to an interior of a dry drum. Particularly, a heat pump cycle type laundry drying machine internally includes a heat pump cycle including a compressor, a condenser, an expansion valve, and an evaporator. Also, when the laundry drying machine starts, the compressor is driven to allow a refrigerant to be circulated by undergoing compression, condensation, expansion, and evaporation operations. Also, air flowing in the interior of the dry drum is heated at a high temperature by heat emitted from the compressor, and high-temperature heated air is supplied to the interior of the dry drum.

A condensing type clothes drying machine and a filter checking method thereof are disclosed in Korean Patent Publication No. 10-2005-0041657 (published on May 4, 2005). The prior art reference proposes a method where a filter is plugged (or blocked) by lint in the middle of drying in an electric heater type laundry drying machine which generates heated air by using an electric heater. In the prior art reference, temperature sensors is respectively equipped in a heater and a filter of the laundry drying machine, plugging of the filter is determined based on temperature difference sensed by each of the temperature sensors. That is, the heater type laundry drying machine proposed in the prior art reference uses a phenomenon where air flowing into the heater is reduced due to plugging of the filter, and thus, a temperature near the heater increases rapidly.

However, the prior art reference is technology using a feature where a temperature near the heater rapidly increases due to plugging of the filter in the heater type laundry drying machine, and for this reason, cannot be applied to heat pump cycle type laundry drying machines. That is, in the heat pump cycle type laundry drying machines, since a heater is not used and a change in a temperature of air which circulates in a laundry drying machine due to plugging of a filter is relatively small, it is difficult to sense plugging of the filter in the middle of drying. When the filter is plugged, the amount of air which flows into an interior of a drum due to plugging of the filter is reduced, and for this reason, a drying performance of a laundry drying machine is reduced.

The above reference is incorporated by reference herein where appropriate for appropriate teachings of additional or alternative details, features and/or technical background.

BRIEF DESCRIPTION OF THE DRAWINGS

The embodiments will be described in detail with reference to the following drawings in which like reference numerals refer to like elements and wherein.

DETAILED DESCRIPTION

Reference will now be made in detail to the embodiments of the present disclosure, examples of which are illustrated in the accompanying drawings.

In the following detailed description of the preferred embodiments, reference is made to the accompanying drawings that form a part hereof, and in which is shown by way of illustration specific preferred embodiments in which the disclosure may be practiced. These embodiments are described in sufficient detail to enable those skilled in the art to practice the disclosure, and it is understood that other embodiments may be utilized and that logical structural, mechanical, electrical, and chemical changes may be made without departing from the spirit or scope of the disclosure. To avoid detail not necessary to enable those skilled in the art to practice the disclosure, the description may omit certain information known to those skilled in the art. The following detailed description is, therefore, not to be taken in a limiting sense.

Also, in the description of embodiments, terms such as first, second, A, B, (a), (b) or the like may be used herein when describing components of the present disclosure. Each of these terminologies is not used to define an essence, order or sequence of a corresponding component but used merely to distinguish the corresponding component from other component(s). It should be noted that if it is described in the specification that one component is "connected," "coupled" or "joined" to another component, the former may be directly "connected," "coupled," and "joined" to the latter or "connected", "coupled", and "joined" to the latter via another component.

As an example of a laundry drying machine to which a control method according to an embodiment of the present disclosure is applied, a heat pump type laundry drying machine will be described below. In the following description, an expansion valve applied to a heat pump cycle is limited to a pulse driving electron expansion valve.

Figure 1:
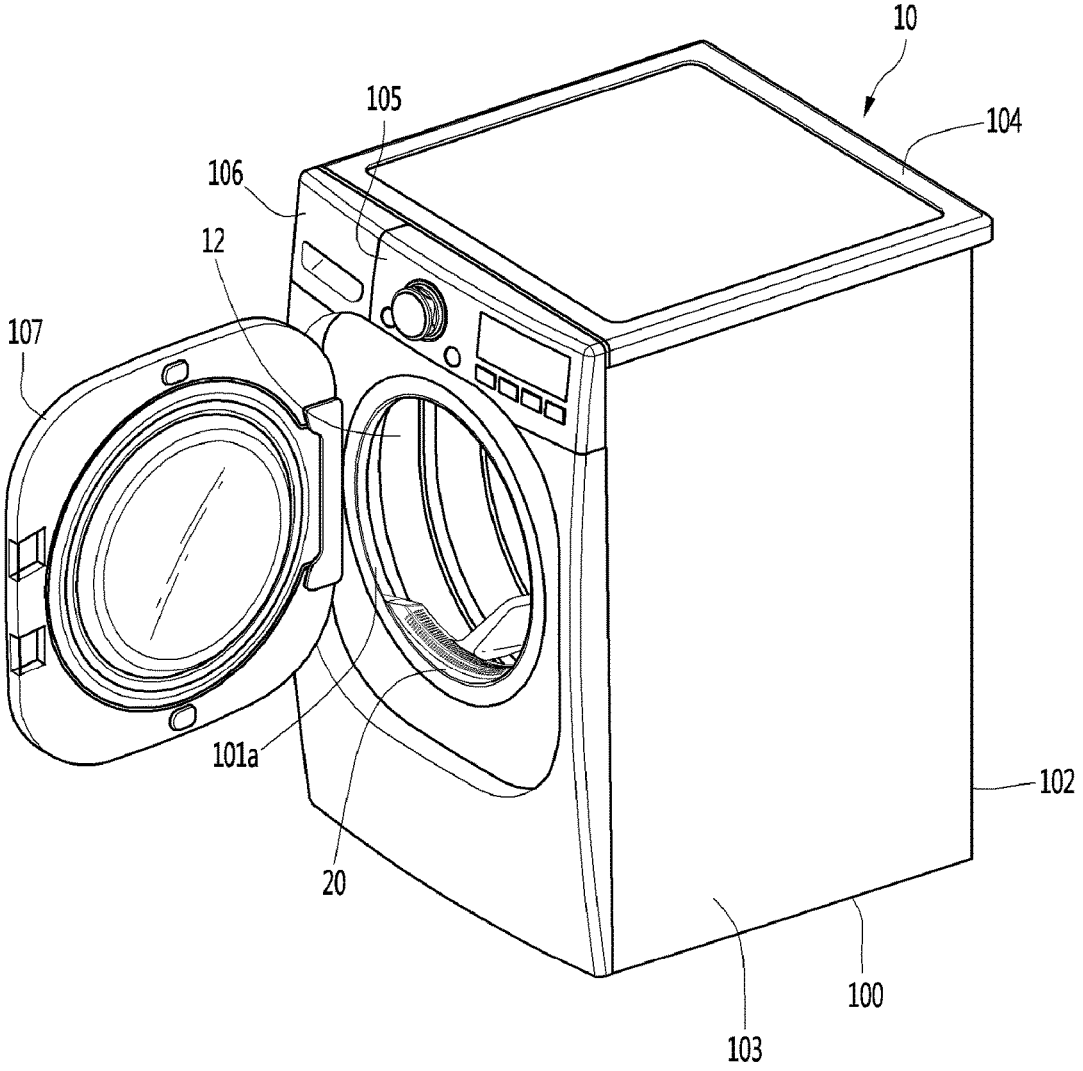
FIG. 1 is a perspective view of a laundry drying machine where a control method according to an embodiment of the present disclosure is implemented.
Figure 2:
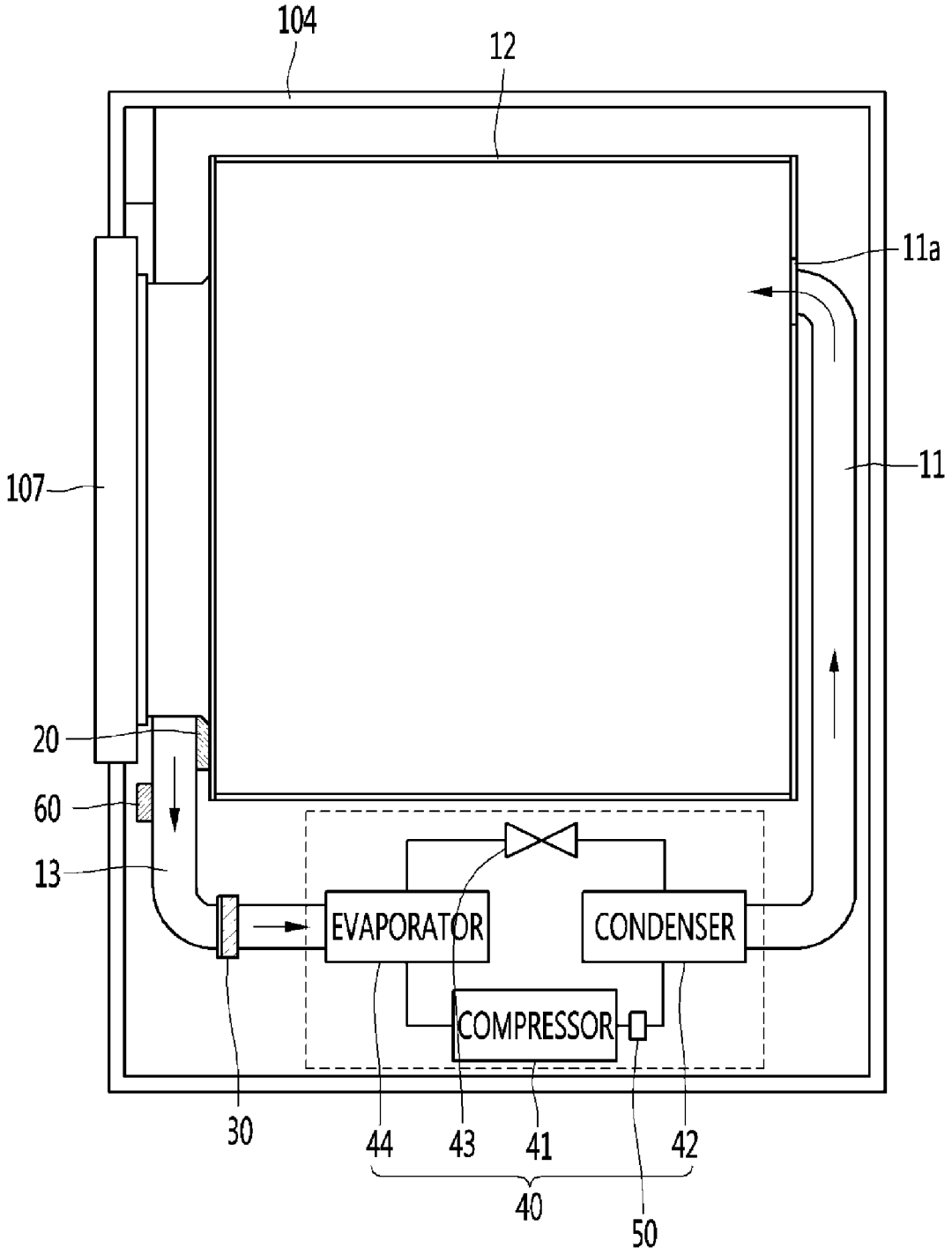
FIG. 2 is a schematic diagram for showing a heat pump cycle included in the laundry drying machine.
Figure 3:
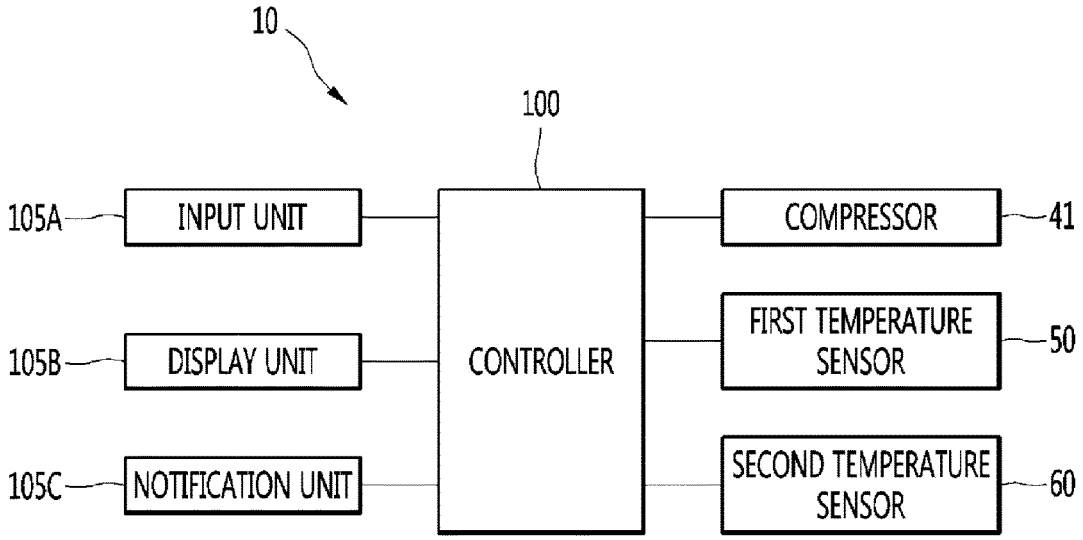
FIG. 3 is a block diagram illustrating a configuration of the laundry drying machine.

FIG. 1 is a perspective view of a laundry drying machine where a control method according to an embodiment of the present disclosure is implemented, FIG. 2 is a schematic diagram for showing a heat pump cycle included in the laundry drying machine, and FIG. 3 is a block diagram illustrating a configuration of the laundry drying machine.

Referring to FIGS. 1 to 3, a laundry drying machine 10 to which the control method according to an embodiment of the present disclosure is applied may include a cabinet, a door 107 which is rotatably coupled to a front surface of the cabinet, and a dry drum 12 which is accommodated into the cabinet. A handle may be provided on one side of a front of the door 107.

In detail, the cabinet may include a base plate 100, a front cabinet 101 which stands in a front end of the base plate 100, a rear cabinet 102 which stands in a rear end of the base plate 100, a pair of side cabinets 103 which respectively connect both side ends of the front cabinet 101 and both side ends of the rear cabinet 102, and a top plate 104 which is provided on an upper end of each of the front cabinet 101, the rear cabinet 102, and the side cabinets 103/

In more detail, an introduction port 101*a* for introduction of the laundry may be provided in the front cabinet 101. Also, the door 107 may be rotatably coupled to the front cabinet 101, and the introduction port 101*a* may be selectively opened or closed by the door 107.

A filter assembly (or filter) 20 may be mounted on a rear surface of the front cabinet 101, in detail, between a lower end of the introduction port 101*a* and a lower end of the front cabinet 101. The filter assembly 20 may perform a function of guiding high temperature and humid air, which is emitted from the dry drum 12 in a drying process, to a blowing fan 30 and a function of filtering out foreign materials including lint included in the high temperature and humid air.

A control panel 105 may be mounted on a front upper side of the front cabinet 101, in detail, between an upper end of the introduction port 101*a* and the an upper end of the front cabinet 101. An input unit 105A for selecting an operation mode of the laundry drying machine 10 and a display unit 105B for displaying various pieces of information including a driving state may be provided in the control panel 105.

Moreover, a notification unit (or notification interface) 105C for notifying a need of cleaning the filter assembly 20 while the laundry drying machine 10 is operating may be further provided in the control panel 105. When plugging (or blockage) of the filter assembly 20 in a drying operation of the laundry drying machine 10 is sensed, the notification unit 105C may output filter cleaning notification by using at least one of sound, light, and display.

Moreover, a drawer 106 for storing condensate water occurring in a drying operation may be mounted on a side of the control panel 105. The drawer 106 may pass through the front cabinet 101 and may be sliding-inserted into the cabinet, or may be sliding-unloaded to outside of the cabinet.

A heat pump cycle 40 for generating heated air may be included in the cabinet. The heat pump cycle 40 may include a compressor 41, a condenser 42, an expansion valve 43, and an evaporator 44. A refrigerant may circulate the heat pump cycle 40 to undergo a phase change and a temperature/pressure change, thereby generating heated air.

Moreover, a heated air supply channel for supplying heated air to an interior of the dry drum 12 may be included in the cabinet. Here, the heated air supply channel may include a circulation type supply channel. In detail, the circulation type supply channel may include a suction duct 11, which sucks high-temperature air generated through the heat pump cycle 40 to the dry drum 12, and an exhaust duct 13 which guides air discharged from the dry drum 12 to the heat pump cycle 40 side. The suction duct 11 and the exhaust duct 13 divide suction and exhaust with respect to the dry drum 12. A dry fan 30 for forcibly circulating air discharged from the dry drum 12 may be installed at an arbitrary position of the exhaust duct 13.

In more detail, the suction duct 11 may connect a space, where the condenser 42 is located, to an air inflow hole 11*a* provided on a rear surface of the dry drum 12. Also, the exhaust duct 13 may connect an air emission hole (not shown), provided in a front lower side of the dry drum 12, to a space where the evaporator 44 is located. In this case, the space where the evaporator 44 is located may communicate with the space where the condenser 42 is located. Therefore, air which is heated by exchanging heat with a refrigerant in the middle of passing through the condenser 42 may flow along the suction duct 11 and may be supplied to the interior of the dry drum 12.

Heated air supplied to the interior of the dry drum 12 may dry the laundry inside the dry drum 12. Also, high temperature and humid air which has absorbed moisture in a laundry drying operation may be guided to the exhaust duct 12 by the dry fan 30 after foreign materials are filtered out by passing through the filter assembly 20. Also, the high temperature and humid air flowing along the exhaust duct 13 may be condensed by passing through the evaporator 44. Therefore, moisture included in air supplied to the exhaust duct 13 may be condensed, and low temperature and dry air may be supplied to the condenser 42 side.

In the present embodiment, a condensing component for condensing humid air flowing along the exhaust duct 13 is described as an evaporator, but is not limited thereto. In addition to the evaporator, various other components may be proposed. Also, the condensate water occurring in a condensing operation performed in the evaporator 44 side may be collected to the drawer 106 by a condensing pump (not shown).

To provide description on a refrigerant circulation of the heat pump cycle 40, when the compressor 41 is driven, the refrigerator may be compressed to a high-pressure vapor refrigerant and may be transferred to the condenser 42. Also, the condenser 42 may phase-change a high-temperature and high-pressure vapor refrigerant to a high-pressure liquid refrigerant. In this case, heat emitted from the condenser 42 may flow into the interior of the dry drum 12 through suction duct 11 by using the dry fan 30. The high-temperature and high-pressure liquid refrigerant obtained through the phase-change by the condenser 42 may be expanded a low-temperature and low-pressure two-phase refrigerant by passing through the expansion value 43, and then, may be evaporated as a low-temperature and low-pressure vapor refrigerant in the evaporator 44. At this time, humid air flowing along the exhaust duct 13 may be compressed by cold air emitted in a refrigerant evaporating operation performed by the evaporator 44.

Although not shown, the dry fan 30 may be connected to a rotational shaft of a driving motor (not shown) that generates a driving force for rotating the dry drum 12, and may rotate along with the dry drum 12. That is, a pulley may be connected to the rotational shaft of the driving motor, and a rotational belt may be wounded on an outer circumference surface of each of the dry drum 12 and the pulley, whereby the rotational force of the driving motor may be transferred to the dry drum 12.

A drying operation of the laundry drying machine 10 having the above-described configuration will be briefly described, and a dry target item may be introduced into the interior of the dry drum 12 through the introduction port 101*a* included in the front cabinet 101. Also, when a dry start command is input, the driving motor may be driven, and the dry drum 12 and the dry fan 30 may rotate in one direction. Also, air flowing into the exhaust duct 13 may be heated at a high temperature by the compressor 41 of the heat pump cycle 40. Also, the air heated at the high temperature may flow into the interior of the dry drum 12 through a rear surface of the dry drum 12 along the suction duct 11. Also, the high-temperature dried air flowing into the interior of the dry drum 12 may dry the dry target item and may be changed to high temperature and humid air. Also, the high temperature and humid air may pass through the filter assembly in a state of including lint occurring in the dry target item and may be guided to the exhaust duct 13. The high temperature and humid air passing through the filter assembly 20 may flow into the evaporator 44 side along exhaust duct 13 after the lint is filtered out.

A problem where the filter assembly 20 is plugged by foreign materials occurs in the drying operation of the laundry drying machine 10. Particularly, in a high-speed dry mode, a phenomenon where foreign materials are caught in the filter assembly 20 is more accelerated, and for this reason, air cannot smoothly circulate, causing a reduction in a dry speed.

Therefore, in the present disclosure, the laundry drying machine 10 may include a first temperature sensor 50 and a second temperature sensor 60 for sensing plugging of a filter which occurs in the drying operation of the laundry drying machine 10. Also, in the present disclosure, when plugging of the filter is sensed through the first temperature sensor 50 and the second temperature sensor 60, filter cleaning notification for notifying a need of cleaning the filter may be output.

In detail, the first temperature sensor 50 may be provided in a refrigerant outlet side of the compressor 41 and may sense a temperature (hereinafter referred to as a compressor outlet temperature ((TE)) of a refrigerant discharged from the compressor 41. For example, the first temperature sensor 50 may be provided at an arbitrary position of a refrigerant pipe that connects the compressor 41 and the condenser 42.

Moreover, the second temperature sensor 60 may be provided in an outlet side of the dry drum 12 and may sense a temperature (hereinafter referred to as a drum outlet temperature (TD)) of the outlet side of the dry drum 12. For example, the second temperature sensor 60 may be provided on one side of the exhaust duct 13 connected to the outlet side of the dry drum 12. However, the present embodiment is not limited thereto. In other embodiments, the second temperature sensor 60 may be provided in a front end of the filter assembly 20 and may sense a temperature of air passing through the filter assembly 20.

Also, the laundry drying machine 10 may further include a controller 100 that determines plugging of the filter, based on temperatures sensed by the first temperature sensor 50 and the second temperature sensor 60. The controller 100 may operate the compressor 41, based on a command input through the input unit 105A, and when a specific criterion is satisfied, the controller 100 may control the first temperature sensor 50 and the second temperature sensor 60 to respectively determine the compressor outlet temperature (TE) and the drum outlet temperature (TD). Also, the controller 100 may allow the notification unit 105C to output the filter cleaning notification, based on a difference between the compressor outlet temperature (TE) and the drum outlet temperature (TD).

Figure 4:
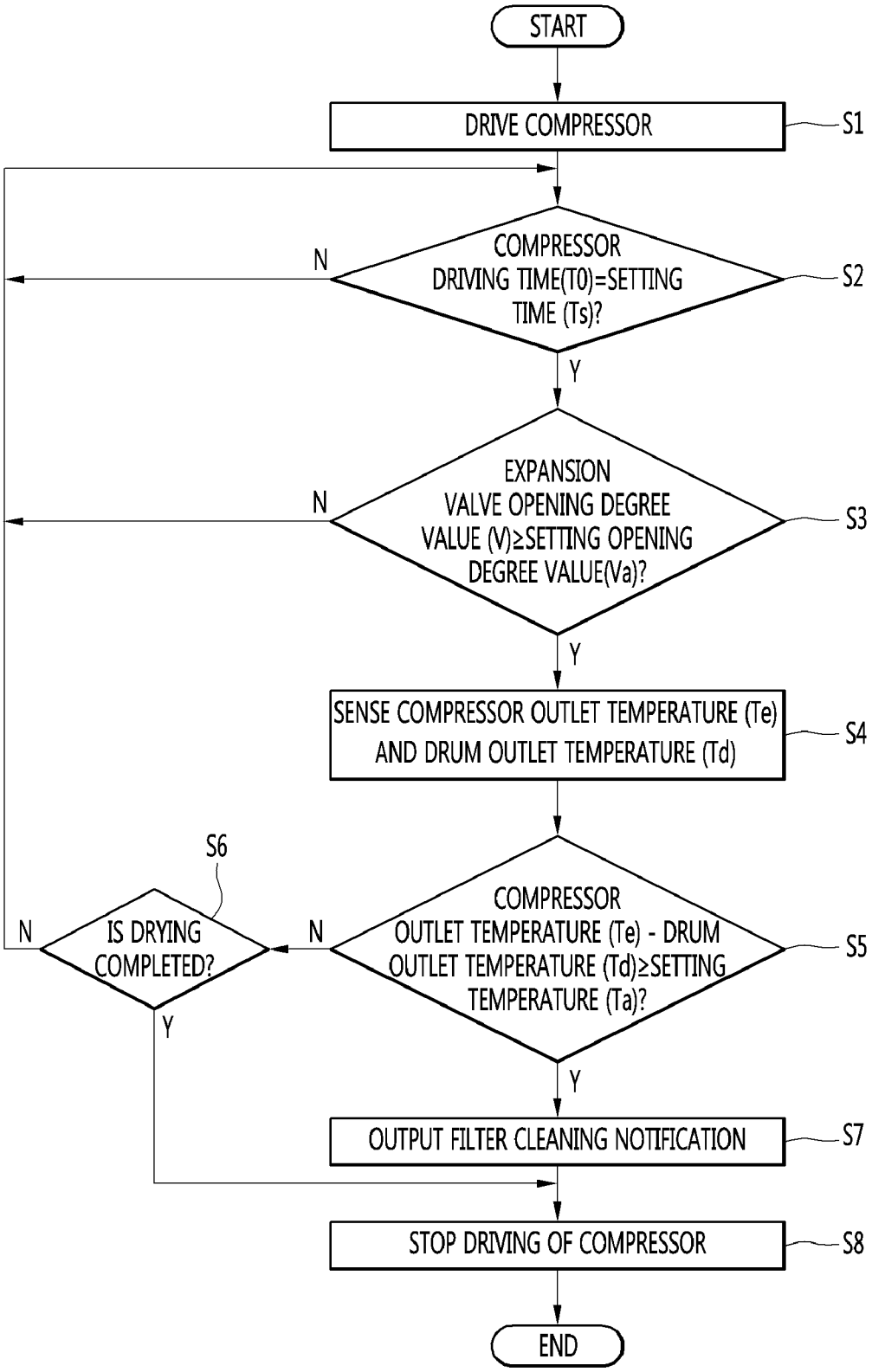
FIG. 4 is a flowchart illustrating a filter plugging sensing method of a laundry drying machine according to another embodiment of the present disclosure.

A detailed control method of the controller 100 will be described below in detail. FIG. 4 is a flowchart illustrating a filter plugging sensing method of a laundry drying machine according to another embodiment of the present disclosure. Referring to FIG. 4, the laundry drying machine (a controller) according to an embodiment of the present disclosure may receive a dry start signal after power is turned on. For example, the controller 100 may receive a dry mode through the input unit 105A and may drive the compressor 41 according to the received dry mode. (S1)

When the compressor is driven in operation S1, the controller 100 may determine a driving time T0 of the compressor 41 arrives a setting time (TS) (also referred to as a "prescribed time"). Here, the setting time (TS) may be five minutes, but is not limited thereto. (S2)

When it is determined in operation S2 that the driving time TO of the compressor arrives the setting time (TS), the controller 100 may determine whether an opening degree value (V) of the expansion valve 43 is equal to or more than a setting opening degree value (VA) or not. (S3) That is, operation S3 may be understood as an operation of determining whether the expansion valve 43 has an opening degree value within a normal range.

Generally, the compressor 41 may be repeatedly turned on or off, an initial setting opening degree (VA) of the expansion valve 43 may be one of values within a pulse range of 68 to 74, and in detail, may be a pulse of 71. However, immediately after the compressor 41 is turned on from a turn-off state, the opening degree value (V) of the expansion valve 43 may have an opening degree value which is less than an opening degree value within the normal range. When the expansion value 43 has the opening degree value which is less than the opening degree value within the normal range, the first and second temperature sensors 50 and 60 cannot sense accurate temperature values. The setting opening degree value (VA) may be a pulse of 65, but is not limited thereto.

When it is determined in operation S3 that the opening degree value (V) of the expansion valve 43 is equal to or more than the setting opening degree value (VA), the controller 100 may sense the compressor outlet temperature (TE) and the drum outlet temperature (TD), and then, may determine whether a difference between the compressor outlet temperature (TE) and the drum outlet temperature (TD) is equal to or more than the setting temperature (TA) (also referred to as a "prescribed temperature difference") or not. That is, the controller 100 may sense an outlet side temperature of the compressor 41 by using the first temperature sensor 50, sense an outlet side temperature of the dry drum 12 by using the second temperature sensor 60, and compare two temperatures.

For example, when plugging of the filter occurs in a drying operation of the laundry drying machine 10, a flow rate of air flowing into the exhaust duct 13 is reduced, and thus, air which is heat-exchanged in the condenser 42 is reduced, whereby a temperature of a discharging side refrigerant of the compressor 41 increases rapidly. Therefore, when plugging of the filter occurs, a difference value between the compressor outlet temperature (TE) and the drum outlet temperature (TD). (S4 and S5) In the present embodiment, the setting temperature (TA) may be one of values within a range of 45° C. to 60° C., but is not limited thereto.

When it is determined in operation S5 that the difference value between the compressor outlet temperature (TE) and the drum outlet temperature (TD) is equal to or more than the setting temperature (TA), the controller 100 may determine that plugging of the filter occurs, and may allow the filter cleaning notification for notifying a need of cleaning the filter to be output. The controller 100 may allow the notification unit 105C to output the filter cleaning notification. Also, the controller 100 may stop driving of the compressor. (S7 and S8)

In the present embodiment, it is described that when it is determined in operation S5 that the difference between the compressor outlet temperature (TE) and the drum outlet temperature (TD) is equal to or more than the setting temperature (TA), the filter cleaning notification is output. However, the present embodiment is not limited thereto. For example, if a state where the difference between the compressor outlet temperature (TE) and the drum outlet temperature (TD) is equal to or more than the setting temperature (TA) is maintained for a specific time (for example, 30 seconds), operation S7 may be performed.

On the other hand, when it is determined in operation S5 that the difference between the compressor outlet temperature (TE) and the drum outlet temperature (TD) is less than the setting temperature (TA), the controller 100 may determine that drying is completed, and when it is determined that drying is completed, the controller 100 may stop driving of the compressor 41. In this case, determining whether drying is completed may be determined by a dry degree sensor equipped in the dry drum 12. (S6 and S8)

When it is determined in operation S6 that drying is not completed, the controller 100 may return to operation S2. Moreover, when it is determined in operation S2 that the compressor driving time T0 does not arrive the setting time (TS), or when it is determined in operation S3 that the expansion valve opening degree value (V) is less than the setting opening degree value (VA) (also referred to as a "prescribed opening degree value"), the controller 100 may return to operation S2.

Figure 5:
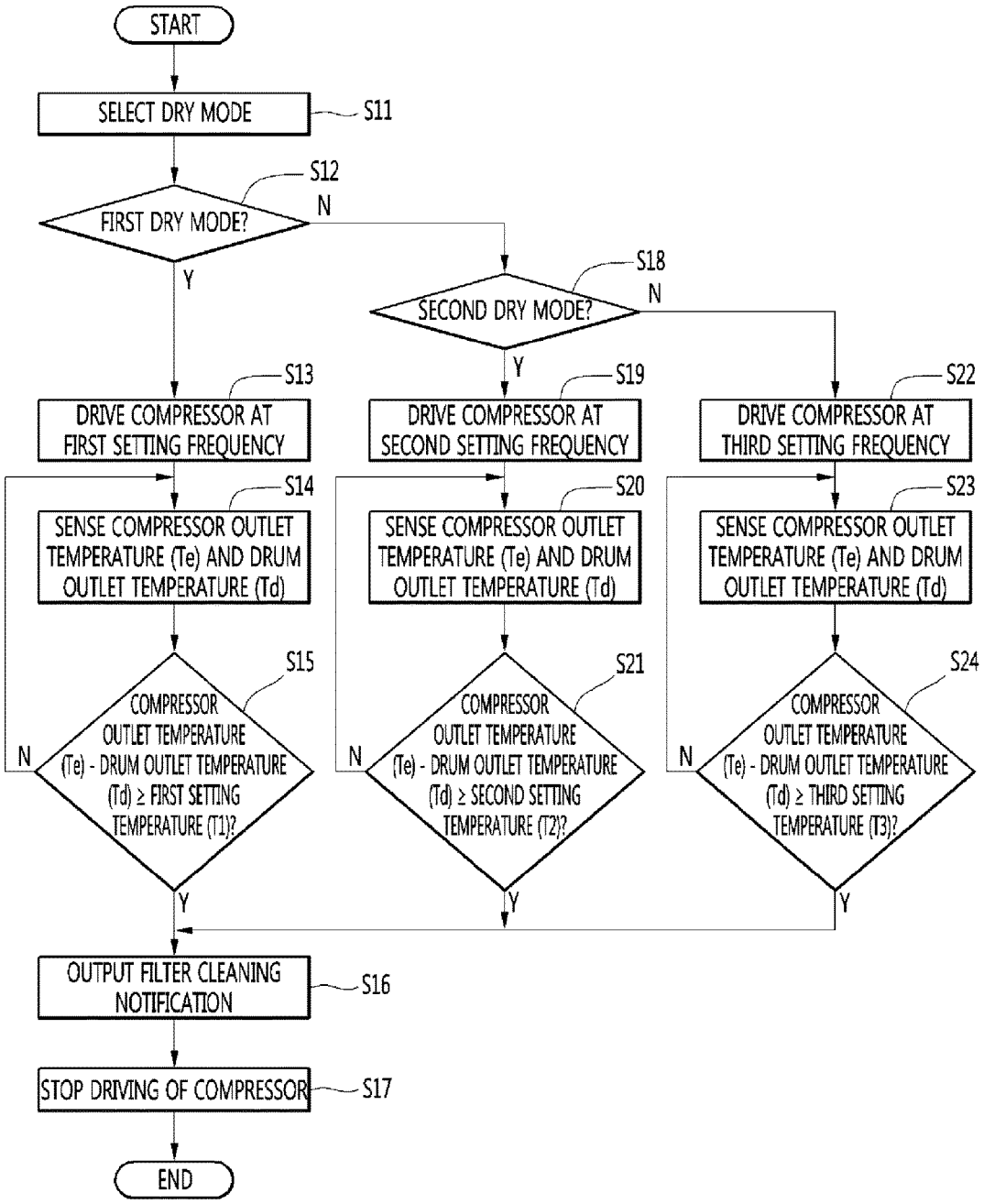
FIG. 5 is a flowchart illustrating a filter plugging sensing method of a laundry drying machine according to an embodiment of the present disclosure.
Figure 6:
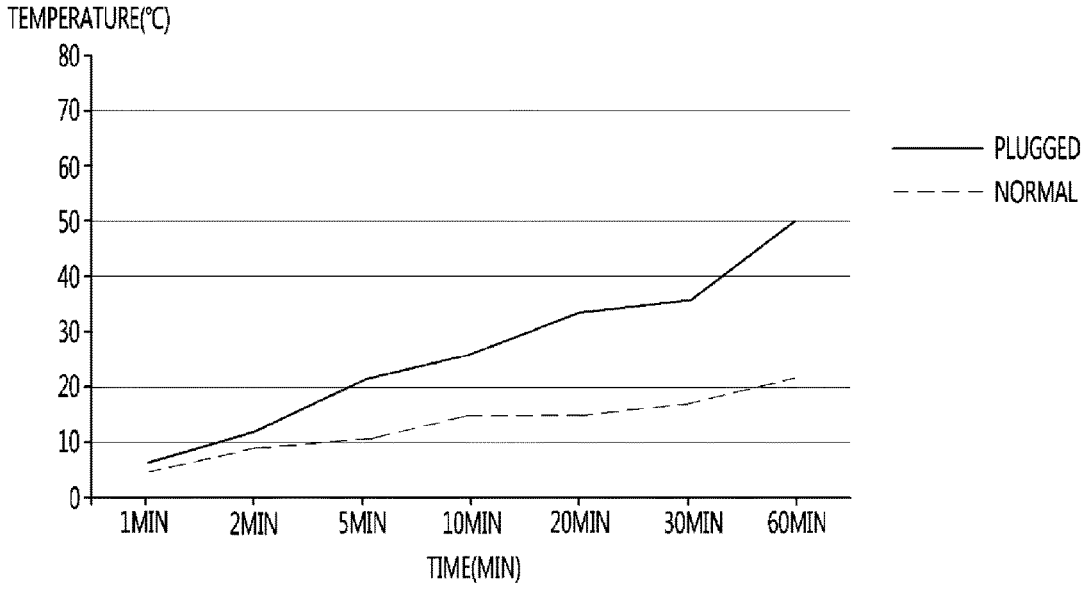
FIG. 6 is a graph showing a difference value between a compressor outlet temperature and a drum outlet temperature based on a first dry mode of the laundry drying machine.
Figure 7:
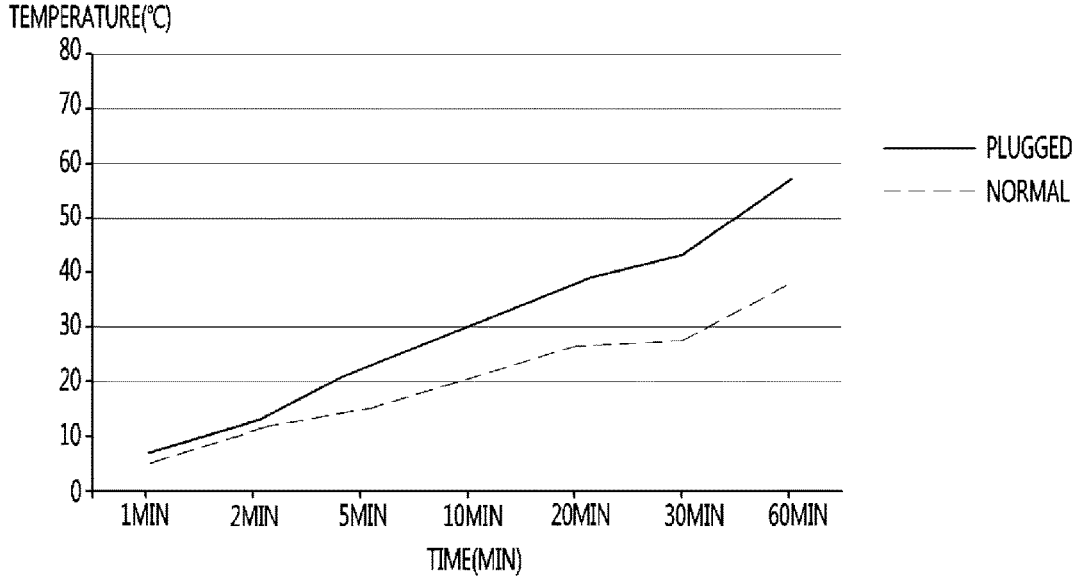
FIG. 7 is a graph showing a difference value between a compressor outlet temperature and a drum outlet temperature based on a second dry mode of the laundry drying machine.
Figure 8:
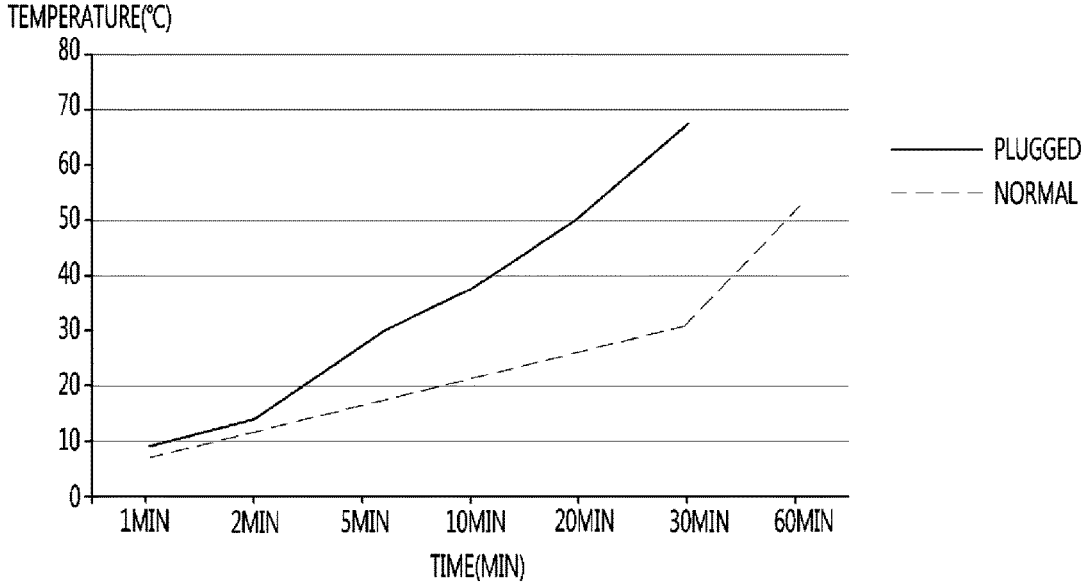
FIG. 8 is a graph showing a difference value between a compressor outlet temperature and a drum outlet temperature based on a third dry mode of the laundry drying machine.

FIG. 5 is a flowchart illustrating a filter plugging sensing method of a laundry drying machine according to an embodiment of the present disclosure, FIG. 6 is a graph showing a difference value between a compressor outlet temperature and a drum outlet temperature based on a first dry mode of the laundry drying machine, FIG. 7 is a graph showing a difference value between a compressor outlet temperature and a drum outlet temperature based on a second dry mode of the laundry drying machine, and FIG. 8 is a graph showing a difference value between a compressor outlet temperature and a drum outlet temperature based on a third dry mode of the laundry drying machine.

In another embodiment of the present disclosure, the laundry drying machine may operate in various dry modes. For example, the various dry modes may include an echo mode (hereinafter referred to as a first dry mode) where the compressor operates at a low frequency, a normal mode (hereinafter referred to as a second dry mode) where the compressor operates at an intermediate frequency, and a speed mode (hereinafter referred to as a third dry mode) where the compressor operates at a high frequency. A user may select one of three modes in consideration of an expectation dry time of a dry target item.

In detail, referring to FIG. 5, the laundry drying machine according to another embodiment of the present disclosure may receive a dry start signal after power is turned on. For example, the controller 100 may receive one of the first dry mode, the second dry mode, and the third dry mode through the input unit 105A of the laundry drying machine and may drive the compressor 41 at a setting frequency based on the received dry mode. (S11, S12, S13, S18, S19, and S22)

The first dry mode may be a mode where the compressor is driven at a first setting frequency which is relatively low, and in this case, the first setting frequency may be less than 40 Hz. The third dry mode may be a mode where the compressor is driven at a third setting frequency which is relatively high, and in this case, the third setting frequency may be less than 60 Hz. The second dry mode may be a mode where the compressor is driven at a second setting frequency having a value between the first setting frequency and the third setting frequency, and in this case, the second setting frequency may have a value of 50 Hz to 57 Hz.

Moreover, when the compressor is driven at a setting frequency corresponding to the selected dry mode, the controller 100 may sense the compressor outlet temperature (TE) and the drum outlet temperature (TD), and then, may determine whether a difference between the compressor outlet temperature (TE) and the drum outlet temperature (TD) is equal to or more than a setting temperature (one of T1, T2, and T3) based on the selected dry mode. That is, the controller 100 may sense an outlet side temperature of the compressor 41 by using the first temperature sensor 50, sense an outlet side temperature of the dry drum 12 by using the second temperature sensor 60, and compare two temperatures. (S14, S15, S20, S21, S23, and S24)

For example, when plugging of the filter occurs in a drying operation of the laundry drying machine 10, a flow rate of air flowing into the exhaust duct 13 is reduced, and thus, air which is heat-exchanged in the condenser 42 is reduced, whereby a temperature of a discharging side refrigerant of the compressor 41 increases rapidly. Therefore, when plugging of the filter occurs, a difference value between the compressor outlet temperature (TE) and the drum outlet temperature (TD).

In this case, the first dry mode, the second dry mode, and the third dry mode may have setting temperatures T1, T2, and T3 having different values. In detail, referring to FIGS. 6 to 8, it can be seen that when 30 minutes elapse from a time when plugging of the filter occurs, the difference between the compressor outlet temperature (TE) and the drum outlet temperature (TD) is 36° C. in the second dry mode, is 44° C. in the first dry mode, and is 67° C. in the third dry mode. That is, it can be seen that when plugging of the filter occurs, the differences between the compressor outlet temperature (TE) and the drum outlet temperature (TD) differ in the dry modes. Therefore, a reference temperature for determining plugging of the filter should be differently designed.

Moreover, the difference between the compressor outlet temperature (TE) and the drum outlet temperature (TD) may be greater in the second dry mode than the first dry mode, and moreover, the difference between the compressor outlet temperature (TE) and the drum outlet temperature (TD) may be greater in the third dry mode than the second dry mode. Therefore, a second setting temperature T2 in the second dry mode may be set lower than a first setting temperature T1 in the first dry mode and higher than a third setting temperature T3 in the third dry mode. For example, the first setting temperature T1 may be 45° C., the second setting temperature T2 may be 50° C., and the third setting temperature T3 may be 60° C.

When it is determined in operations S15, S21, and S24 that the difference between the compressor outlet temperature (TE) and the drum outlet temperature (TD) is equal to or more than each of the setting temperatures T1, T2, and T3, the controller 100 may determine that plugging of the filter occurs, and may allow the filter cleaning notification for notifying a need of cleaning the filter to be output. The controller 100 may allow the notification unit 105C to output the filter cleaning notification. Also, the controller 100 may stop driving of the compressor. (S16 and S17)

The control method for the laundry drying machine according to the embodiments of the present disclosure having the above-described configuration has the following effects. First, plugging of the filter which occurs in the drying operation of the laundry drying machine using the heat pump cycle is accurately sensed. Second, since plugging of the filter is sensed and is notified to a user, the user can quickly clean the filter, thereby preventing dry performance from being reduced due to plugging of the filter. Third, only in a case of satisfying a specific criterion, the compressor outlet temperature and the drum outlet temperature may be sensed, thereby minimizing power consumption necessary for sensing plugging of the filter.

The present disclosure is proposed for solving the above-described problems. To achieve these and other advantages and in accordance with the purpose of the disclosure, as embodied and broadly described herein, there is provided a control method for a laundry drying machine including a heat pump cycle, the control method including: driving a compressor configuring the heat pump cycle for generation of heated air; sensing a compressor outlet temperature (TE) and a drum outlet temperature (TD); and determining plugging of a filter, based on a difference between the compressor outlet temperature (TE) and the drum outlet temperature (TD).

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

Any reference in this specification to "one embodiment," "an embodiment," "example embodiment," etc., means that a particular feature, structure, or characteristic described in connection with the embodiment is included in at least one embodiment of the disclosure. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A method to control a laundry drying machine including a heat pump cycle to generate heated air, the method comprising:

driving a compressor;

sensing a compressor outlet temperature (TE) at an outlet of the compressor and a drum outlet temperature (TD) at an exhaust duct of a drum of the laundry drying machine; and determining that plugging of a filter at the exhaust duct occurs based on determining that a difference between the compressor outlet temperature (TE) and the drum outlet temperature (TD) is equal to or greater than a prescribed temperature difference (TA), wherein the compressor is driven at one dry mode of a plurality of dry modes, wherein the plurality of dry modes include a first dry mode in which the compressor is driven at a first frequency and a second dry mode in which the compressor is driven at a second frequency that is higher than the first frequency, wherein when the compressor is driven in the first dry mode, the prescribed temperature difference (TA) is a first temperature difference (T1), wherein when the compressor is driven in the second dry mode, the prescribed temperature difference (TA) is a second temperature difference (T2), and wherein the second temperature difference (T2) is greater than the first temperature difference (T1).

2. The method of claim 1, further comprising:

determining whether a compressor driving time (T0) that the compressor is driven exceeds a prescribed time (TS), wherein the compressor outlet temperature (TE) and the drum outlet temperature (TD) are sensed based on determining that the compressor driving time (T0) exceeds to the prescribed time (TS).

3. The method of claim 2, further comprising:

determining, after the compressor driving time (T0) exceeds the prescribed time (TS), whether an opening degree value (V) of an expansion valve included in the heat pump cycle is equal to or greater than a prescribed opening degree value (VA), wherein the compressor outlet temperature (TE) and the drum outlet temperature (TD) are sensed further based on determining that the opening degree value (V) of the expansion valve is equal to or greater than the prescribed opening degree value (VA).

4. The method of claim 1, further comprising:

outputting a filter cleaning notification indicating that the filter should be cleaned based on determining that plugging of the filter occurs.

5. The method of claim 1, further comprising:

stopping the driving of the compressor based on determining that plugging of the filter occurs.

6. The method of claim 1, wherein the plurality of dry modes further includes a third dry mode in which the compressor is driven at a third frequency that is greater than the first and second frequencies.

7. The method of claim 6, wherein the prescribed temperature difference (TA) is a third temperature difference (T3) when the compressor is driven in the third dry mode, and the first temperature difference (T1), the second temperature difference (T2), and the third temperature difference (T3) are different.

8. The method of claim 7, wherein the second temperature difference (T2) is higher than the first temperature difference (T1) and lower than the third temperature difference (T3).

9. The method of claim 7, wherein the first temperature difference (T1) is 45° C., the second temperature difference (T2) is 50° C., and the third temperature difference (T3) is 60° C.

10. The method of claim 1, wherein the heat pump cycle includes:

the compressor that compresses a refrigerant to form a high-temperature and high-pressure vapor refrigerant;

a condenser that condenses the high-temperature and high-pressure vapor refrigerant from the compressor to form a high-temperature and high-pressure liquid refrigerant;

an expansion valve that expands the high-temperature and high-pressure liquid refrigerant from the compressor to form a low-temperature and low-pressure two-phase refrigerant; and an evaporator that evaporates the low-temperature and low-pressure two-phase refrigerant from the expansion valve to form a low-temperature and low-pressure vapor refrigerant, and wherein the refrigerant circulates in the heat pump cycle to generate the heated air.

11. A laundry drying machine comprising:

a heat pump cycle to heat air;

a first temperature sensor that senses a first temperature at an inlet of the heat pump cycle;

a second temperature sensor that senses a second temperature at an outlet of the heat pump cycle; and a controller that determines that plugging of a filter at the inlet of the heat pump cycle occurs based on determining that a difference between the first temperature and the second temperature is equal to or greater than a prescribed temperature difference, wherein the second temperature includes a compressor outlet temperature (TE) at an outlet of a compressor included in the heat pump cycle, wherein the first temperature includes a drum outlet temperature (TD) at an exhaust duct of a drum of the laundry drying machine, wherein the compressor is driven at one dry mode of a plurality of dry modes, wherein the plurality of dry modes include a first dry mode where the compressor is driven at a first frequency and a second dry mode where the compressor is driven at a second frequency that is higher than the first frequency, wherein when the compressor is driven at the first dry mode, the prescribed temperature difference is a first temperature difference (T1), wherein when the compressor is driven at the second dry mode, the prescribed temperature difference is a second temperature difference (T2), and wherein the second temperature difference (T2) is greater than the first temperature difference (T1).

12. The laundry drying machine of claim 11, wherein the controller further stops a driving of the heat pump cycle when plugging of the filter occurs.

13. The laundry drying machine of claim 11, further comprising:

a notification interface that outputs a notification when plugging of the filter occurs.

14. The laundry drying machine of claim 11, wherein the second temperature is sensed after the heat pump cycle is driven for at least a prescribed time (TS).

15. The laundry drying machine of claim 11, wherein the second temperature is sensed after an opening degree value of an expansion valve included in the heat pump cycle is equal to or greater than a prescribed opening degree value (VA).

16. The laundry drying machine of claim 11, wherein the heat pump cycle circulates a refrigerant to generate heated air, and includes:

a compressor that compresses the refrigerant to form a high-temperature and high-pressure vapor refrigerant, a condenser that condenses the high-temperature and high-pressure vapor refrigerant from the compressor to form a high-temperature and high-pressure liquid refrigerant;

an expansion valve that expands the high-temperature and high-pressure liquid refrigerant from the compressor to form a low-temperature and low-pressure two-phase refrigerant; and an evaporator that evaporates the a low-temperature and low-pressure two-phase refrigerant from the expansion valve to form a low-temperature and low-pressure vapor refrigerant.

17. The laundry drying machine of claim 11, wherein the plurality of dry modes further includes a third dry mode in which the compressor is driven at a third frequency that is greater than the first and second frequencies, wherein the prescribed temperature difference (TA) is a third temperature difference (T3) when the compressor is driven in the third dry mode, wherein the first temperature difference (T1), the second temperature difference (T2), and the third temperature difference (T3) are different, and wherein the second temperature difference (T2) is higher than the first temperature difference (T1) and lower than the third temperature difference (T3).

18. The laundry drying machine of claim 17, wherein the first temperature difference (T1) is 45° C., the second temperature difference (T2) is 50° C., and the third temperature difference (T3) is 60° C.

19. The laundry drying machine of claim 11, wherein the compressor outlet temperature (TE) is a temperature of a refrigerant compressed by the compressor.

20. The laundry drying machine of claim 11, wherein the controller determines that the plugging of the filter occurs further based on determining that the difference between the first temperature and the second temperature is equal to or greater than the prescribed temperature difference for at least a prescribed duration of time.

* * * * *